US010687572B2

(12) United States Patent
Baker

(10) Patent No.: US 10,687,572 B2
(45) Date of Patent: Jun. 23, 2020

(54) GARMENT VENTILATION SYSTEM

(71) Applicant: Wolverine Outdoors, Inc., Rockford, MI (US)

(72) Inventor: Neil Baker, Portland, OR (US)

(73) Assignee: Wolverine Outdoors, Inc., Rockford, MI (US)

( * ) Notice: Subject to any disclaimer, the term of this patent is extended or adjusted under 35 U.S.C. 154(b) by 217 days.

(21) Appl. No.: 16/035,198

(22) Filed: Jul. 13, 2018

(65) Prior Publication Data

US 2020/0015530 A1 Jan. 16, 2020

(51) Int. Cl.

| | |
|---|---|
| ***A41D 27/28*** | (2006.01) |
| ***A41D 31/14*** | (2019.01) |
| *A41D 31/00* | (2019.01) |

(52) U.S. Cl.

CPC ..... *A41D 27/28* (2013.01); *A41D 31/14* (2019.02)

(58) Field of Classification Search

CPC ..... A41D 27/28; A41D 1/02; A41D 27/285; A41D 31/14; A41D 13/002; A41D 3/00; A41D 1/04; A41D 3/02; A41D 2600/102; A41D 2300/24; A41D 1/084; A41D 27/00; A41D 27/24; A41D 13/00; A41D 13/0053; A41D 13/0056; A41D 1/08; A41D 2600/104; A41D 31/00; Y10S 2/01; A41B 1/00; A41B 1/08; A41B 2400/20

See application file for complete search history.

(56) References Cited

U.S. PATENT DOCUMENTS

| | | | | |
|---|---|---|---|---|
| 317,711 A * | 5/1885 | Brinkmann | A41D 27/28 2/118 |
| 385,306 A * | 6/1888 | Helwitz | A41D 27/28 2/87 |
| 606,898 A * | 7/1898 | Schoen | A41B 1/02 2/118 |
| 1,015,231 A * | 1/1912 | Jacobs | A41D 1/02 2/115 |
| 1,326,517 A * | 12/1919 | Lieberman | A41D 1/02 2/93 |
| 2,114,514 A * | 4/1938 | York | A41D 27/28 2/93 |

(Continued)

OTHER PUBLICATIONS

Seam. (n.d.) American Heritage® Dictionary of the English Language, Fifth Edition. (2011). Retrieved Mar. 3, 2020 from https://www.thefreedictionary.com/seam (Year: 2011).*

*Primary Examiner* — Robert H Muromoto, Jr.
(74) *Attorney, Agent, or Firm* — Warner Norcross + Judd LLP

(57) ABSTRACT

A garment is provided including an overlap panel, an intermediate panel seamlessly joined with a first lower portion at an outer fold, the intermediate panel including an upper portion disposed above the first lower portion, and an inner panel seamlessly joined with the upper portion at an inner fold, the inner panel extending downward beyond the first lower portion of the overlap panel. The overlap panel, the intermediate panel and the inner panel form a unitary, continuous textile or body. At least one of the intermediate panel and the inner panel define a plurality of vent holes that are concealed by the overlap panel. The vent holes promote venting of air from an interior of the garment to an exterior of the garment or vice versa. A related method of manufacture also is provided.

16 Claims, 7 Drawing Sheets

(56) References Cited

U.S. PATENT DOCUMENTS 2,131,515 A * 9/1938 Jonas ..... A41D 1/02 2/93
2,322,451 A * 6/1943 Jones ..... A41D 1/02 2/93
2,458,004 A * 1/1949 Kerr ..... A41D 3/00 2/93
2,631,290 A * 3/1953 Klepper ..... A41D 27/28 2/87
3,296,626 A * 1/1967 Ludwikowski ..... A41D 27/28 2/87
4,408,356 A * 10/1983 Abrams ..... A41D 27/28 2/87
5,727,256 A * 3/1998 Rudman ..... A41D 27/28 2/115
D491,713 S * 6/2004 Wilson, II ..... D2/849
6,792,621 B2 * 9/2004 Braun ..... A41D 27/285 2/1
7,043,766 B1 * 5/2006 Foreman ..... A41B 9/06 2/81
8,001,618 B2 * 8/2011 Bay ..... A41D 27/28 2/93
8,133,824 B2 * 3/2012 Harber ..... A41D 1/04 442/1
8,187,984 B2 * 5/2012 Rock ..... D06M 15/263 442/64
8,555,414 B2 * 10/2013 Davis ..... A41D 27/28 2/69
8,713,712 B2 * 5/2014 Maurer ..... A41D 27/24 2/93
8,850,615 B2 * 10/2014 Demarest ..... A41D 27/28 2/69
9,974,347 B2 * 5/2018 Audet ..... A41D 31/0027
10,238,157 B2 * 3/2019 Nordstrom ..... A41D 13/002
10,244,804 B2 * 4/2019 Hodgson ..... A41D 3/04
2005/0204449 A1 * 9/2005 Baron ..... D04B 1/16 2/69
2006/0041990 A1 * 3/2006 Alesina ..... A41D 27/28 2/93
2006/0059601 A1 * 3/2006 Opitz ..... A41D 3/00 2/108
2006/0179539 A1 * 8/2006 Harber ..... A41D 13/002 2/69
2006/0277652 A1 * 12/2006 Okajima ..... A41D 13/00 2/93
2013/0333092 A1 * 12/2013 Hodgson ..... A41D 3/04 2/69
2014/0196192 A1 * 7/2014 Koller ..... A41D 3/02 2/85
2017/0065005 A1 * 3/2017 Nordstrom ..... A41D 13/002

* cited by examiner

GARMENT VENTILATION SYSTEM

BACKGROUND OF THE INVENTION

The present invention relates to garments, and more particularly to a garment that includes a vent system to provide ventilation to a wearer.

When engaging in activities in the outdoors, it is common for a person to encounter a variety of environmental conditions. For example, a hiker, runner or other athlete can set off on an excursion or run in the cool morning hours, and continue their activity well into a warming and humid late morning. Some individuals address such temperature changes by donning a jacket that has venting so that excessive heat and perspiration do not build, and instead exit the interior of the jacket via that venting.

There is a variety of vented jackets and other vented clothing in the market. The venting for such clothing frequently is formed from a simple, open mesh that is located in an area of high heat build-up and perspiration, such as in an underarm region of a jacket. The mesh usually is visible to others when the jacket is donned by a wearer, particularly when the wearer is moving. Other venting systems are formed as a flap that hangs over a piece of mesh to conceal the mesh so the aesthetics of the jacket are not interrupted by that mesh, and so that precipitation rolls off the jacket, over the flap, and not through the mesh.

Such constructions typically include multiple panels that are stitched to one another. For example, a jacket including such a construction includes an upper flap. A lowermost edge of that upper flap is stitched along a horizontal stitch line to a middle flap that angles upward from the lower edge, back toward an interior of the jacket. The upper edge of that middle flap is stitched along another horizontal stitch line to a vertical strip of mesh that forms the vent to the interior of the jacket. The mesh is stitched along yet another horizontal stitch line at its lower edge to another vertical panel that extends to the bottom of the jacket. The mesh and its lower edge stitch line are elevated above the lower edge of the upper flap, so the upper flap conceals the mesh when the upper flap is normally draped on a wearer.

While the above mesh construction provides ventilation to the interior of the jacket, it suffers some shortcomings. For example, the above vent system takes multiple pieces of material to assemble it. The different pieces need be carefully cut to size and shape, which can be tedious, and can lead to issues where different size jackets are assembled in one area, increasing the odds that the pieces are improperly mix and matched. In addition, with so many pieces to stitch along stitch lines, the jacket is labor intensive to assemble and manufacture. Where a stitch line is imperfect or is tugged on during use of the jacket, the pieces of material can detach from one another, potentially ruining the jacket. The types of materials and threads for the stitch lines also can be limited where those stitch lines and thread are desired to be fully concealed under a light colored or semi-translucent upper flap. Further, due to the multiple horizontal stitch lines in the vent system, the jacket in that vented region tends to be rather rigid and non-stretchable. This can impair movement of the wearer of the jacket.

Accordingly, there remains room for improvement in the field of garments having ventilation systems.

SUMMARY OF THE INVENTION

A garment is provided including a ventilation system having a panel that is folded upon itself and over a system of vent holes so that the vent holes are concealed from view, yet still promote venting of air from an interior of the garment to an exterior of the garment and vice versa.

In one embodiment, the garment can include an overlap panel, an intermediate panel seamlessly joined with a first lower portion at an outer fold, the intermediate panel including an upper portion disposed above the first lower portion, and an inner panel seamlessly joined with the upper portion at an inner fold, the inner panel extending downward beyond the first lower portion of the overlap panel.

In another embodiment, the overlap panel, the intermediate panel and the inner panel form a unitary, continuous textile or body. The intermediate panel and/or the inner panel can define one or more vent holes that are concealed by the overlap panel. The vent holes promote venting of air from an interior of the garment to an exterior of the garment or vice versa.

In still another embodiment, the panels can be bonded or adhered to one another. For example, the overlap panel can be joined with bonding tape or a weld to the intermediate panel adjacent the outer fold. This can allow the outer fold there to keep its shape, and to conceal the vent holes under the intermediate panel. As another example, the intermediate panel can be joined with bonding tape to the inner panel adjacent the inner fold. The tape, weld or other bonding element can be positioned distal from the vent holes so the same do not close the vent holes, and optionally do not place the intermediate panel so close to the holes that the intermediate panel closes or substantially covers the holes to prevent venting.

In a further embodiment, the ventilation system can be implemented in a garment that is used in a variety of activities. Exemplary garments can include a jacket, a parka, a shirt, pants, a dress, a hat, shoes and a variety of other clothing.

In still a further embodiment, the ventilation system can be included in a panel of a jacket, for example a back panel of a jacket. The system and its panels and folds can extend across an upper portion of the back panel, generally under or at shoulder level. The system can be void of any lateral or side to side stitch lines, which can render the system flexible and moveable. In turn, the system does not bind or impair movement of the wearer of the jacket.

In still yet a further embodiment, the ventilation system can be included in a seam in the rear of pants. In such a construction, the system can include first and second side panels disposed laterally of the overlap panel, the intermediate panel and the inner panel. The overlap panel, the intermediate panel and the inner panel cooperatively define a first edge and a second opposing edge that each can be transverse to the outer and inner folds. The first edge can be adjacent the first side panel, and the second edge can be adjacent the second side panel. The overlap panel, the intermediate panel and the inner panel are joined at a seam with at least one of the first side panel and the second side panel. Another piece of material can be joined at the seam below these components, such that the ventilation system is disposed over a posterior of a wearer when the pants are worn. Such a system can provide venting to the pants, yet still be durable and rugged to withstand excessive forces in the posterior region.

In even a further embodiment, the ventilation system can be included in a hat. In such a construction, the various folded panels can extend around a perimeter of the hat, optionally near a brim or at an upper part of the hat or somewhere in between. Multiple inner panels with vent holes can be concealed by multiple overlap panels to provide enhanced ventilation.

In yet another embodiment, the vent holes can be placed in a panel, such as the intermediate panel or the inner panel in a particular area with a particular spacing and shape or size. For example, the holes can be in the form of a circular aperture, and can have a diameter of between 1 mm and 10 mm, inclusive. Adjacent holes can be placed at least 2.5 mm away from one another. The holes also can be disposed along a hole axis that extends parallel to the inner fold and the outer fold. The holes can be placed at least 1 mm away from the inner fold and the outer fold to ensure those holes are not obstructed by a particular panel.

In another further embodiment, a method is provided. The method can include: folding a unitary sheet of material a first time so an overlap panel is on one side of an outer fold and an intermediate panel is on the other side of that fold, with the panels seamlessly joined with one another at the outer fold; folding the unitary sheet a second time at an inner fold to produce an inner panel seamlessly joined with the intermediate panel, with the inner panel extending downward beyond the overlap panel; and defining in at least one of the intermediate panel and the inner panel a plurality of vent holes that are concealed by the overlap panel. The holes are configured to promote venting of air from an interior of the garment to an exterior of the garment or vice versa.

In yet another further embodiment, the method can include cutting the vent holes in a panel or sheet with a laser cutter, die cut or other material cutting machine.

The current embodiments of the garment with a ventilation system and related method of manufacture provide benefits that previously have been unachievable. For example, with the garment made from a sheet or panel, folded to form different panels, the ventilation system can be incorporated into the garment without excess sewing, stitching and associated labor. The panels also can be precisely formed via folding the sheet in a particular manner. The holes can be selectively sized, placed and positioned on the inner and/or intermediate panel to provide good ventilation, yet to conceal the holes from view with the overlap panel. The shape and folds of the system can be maintained via a bond, weld, or adhesive element that can secure one or more of the panels to one another, without significantly impairing the flexibility and movement of the garment in the area where the system is located.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of a garment including the ventilation system is illustrated in FIGS. 1-8, and generally designated 10. The garment is in the form of a jacket. Although illustrated in connection with a jacket, the ventilation system 20 can be incorporated into other type of garments, such as sweatshirts, overshirts, t-shirts, pullovers, hoodies, parkas, shorts, pants, rain coats, warmups, hats, headgear and the like.

Figure 1:
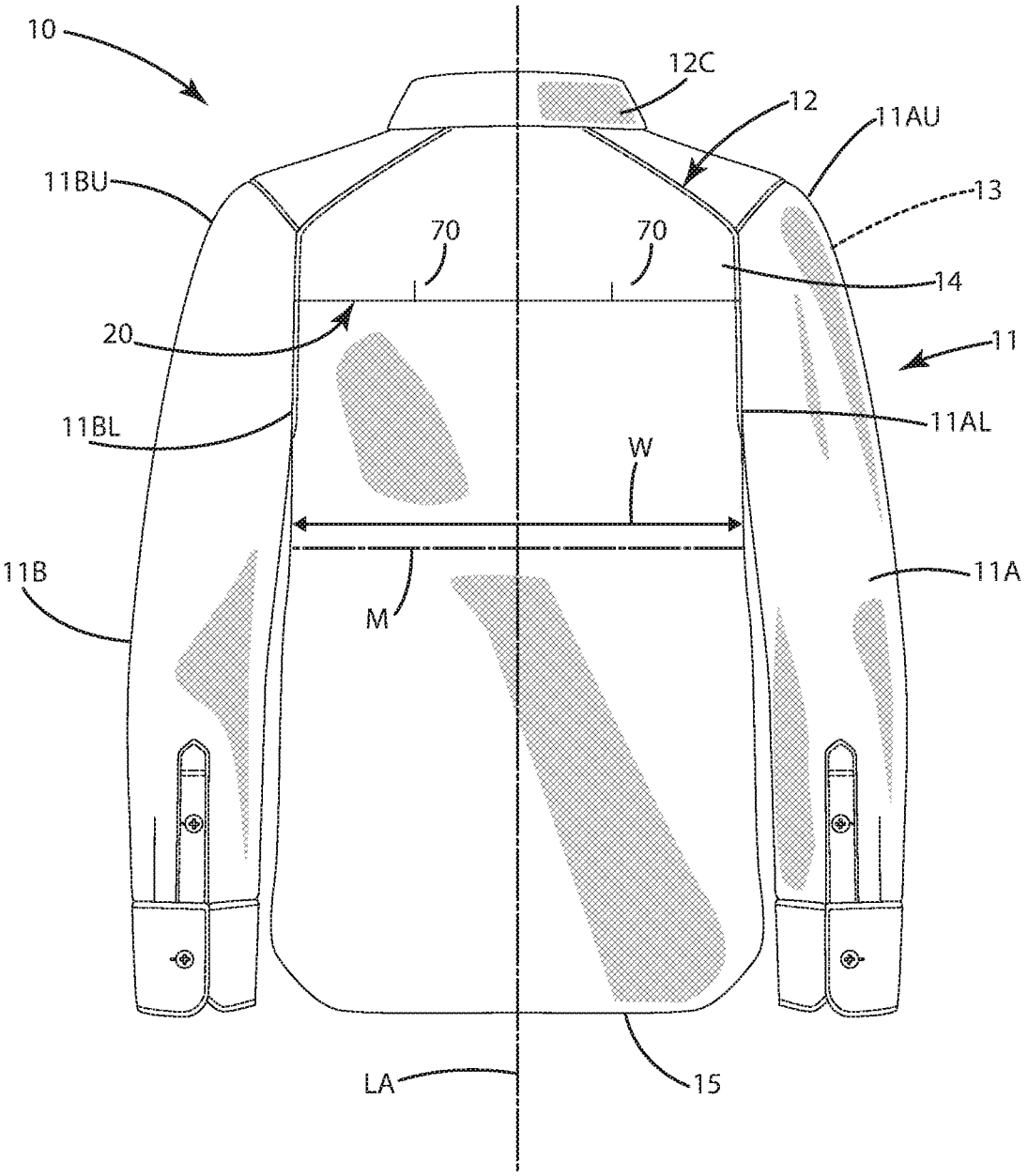
FIG. 1 is a back view of a garment including a vent system of a current embodiment.

With reference to FIG. 1, the jacket 10 can includes a jacket body having a torso portion 11 topped with a shoulder portion 12 adjacent a collar 12C. The torso portion 11 can include first and second arm portions, which optionally can be in the form of full length sleeves 11A, 11B. The torso portion 11 can include a front panel 13 and a back panel 14, each joined with the sleeves 11A, 11B and/or the shoulder portion 12. The torso portion 11 and sleeves 11A, 11B can be of a layered construction, and can include an exterior layer or shell, and can optionally include a lining and insulation (not shown). The shell can be constructed from one or more of polyester taffeta, a polyester woven fabric, such as Versatech®, or any other material suitable for a shell. The lining can be nylon taffeta, a nylon plain weave, polyester tricot, or any other material suitable for a lining and the insulation can be down, synthetic fiberfill or essentially any other garment insulation. The shell, lining, and insulation can be assembled as desired and can include regions of channel quilting or other forms of stitching configured to intersecure the shell, lining, and insulation.

The jacket 10 can include a variety of components, such as pockets, cuffs, and various trim elements. The pockets can include closures, such as zippers, snaps or buttons (not shown). The cuffs can be bound by a spandex material, such as Lycra®, or other similar materials to provide a certain amount of elasticity in the cuffs, while at the same time providing a comfortable and durable interface with the wearer's skin. If desired, the lower hem can include one or more drawstrings (not shown).

The front panel 13 of the jacket 10 can be configured to extend over an anterior of a wearer's torso, and the back panel 14 can be configured to extend over a posterior of a wearer's torso, for example, a wearer's back. The jacket 10 can include a longitudinal axis LA (FIG. 2), and the front and back panels 13, 14 extend across, are transverse to and overlap the longitudinal axis LA.

With reference to FIGS. 1-5, the back panel 14 can include a ventilation system 20. As shown, the ventilation system 20 can be disposed on and/or form a portion of the back panel 14, which is disposed over the anterior portion of the body of a wearer when the jacket 10 is worn. Of course, this ventilation system 20 can be disposed in other parts of the jacket or garment. For example, it can be disposed on the sleeves, in the shoulder portion, on the front panel, around the collar, down the sleeves or in some other location, depending on the application. The ventilation system 20 can be disposed closer to the shoulder portion 12 of the garment 10 than the lower portion or bottom 15 of the jacket 10. For example, the ventilation system 20 can be disposed above the middle part of the jacket 10, optionally in the upper third to upper quarter of the jacket 10. The ventilation system 20 also can be disposed below the uppermost parts 11AU and 11BU of the sleeves, but disposed above the lower most parts 11AL and 11BL of those sleeves. The ventilation system 20 can extend laterally across a width W of the back panel 14 of the jacket 10. Optionally, the ventilation system 20 can extend across the majority of that width, further optionally entirely across the width W between the sleeves. In other cases, the ventilation system 20 can be formed as a short section, that is of a length that is less than the entire width W.

Figure 2:
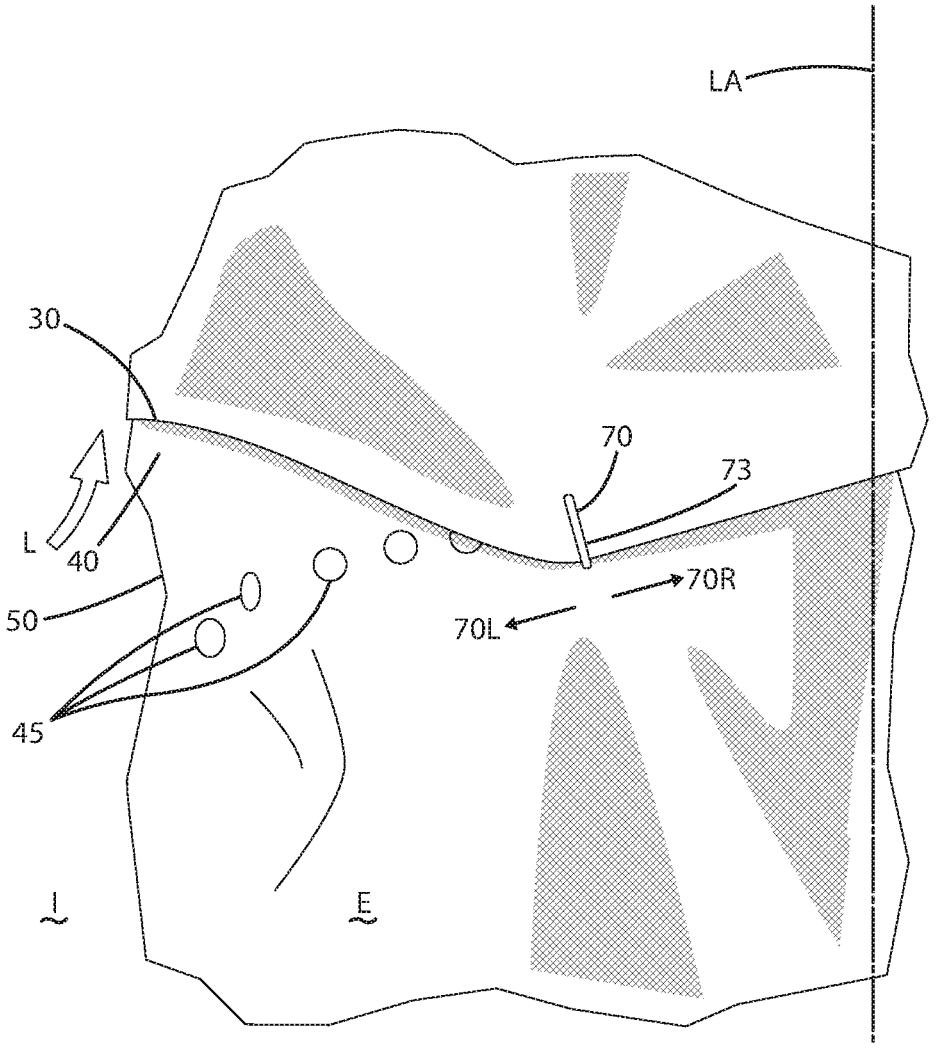
FIG. 2 is a close up view of the vent system partially opened.
Figure 4:
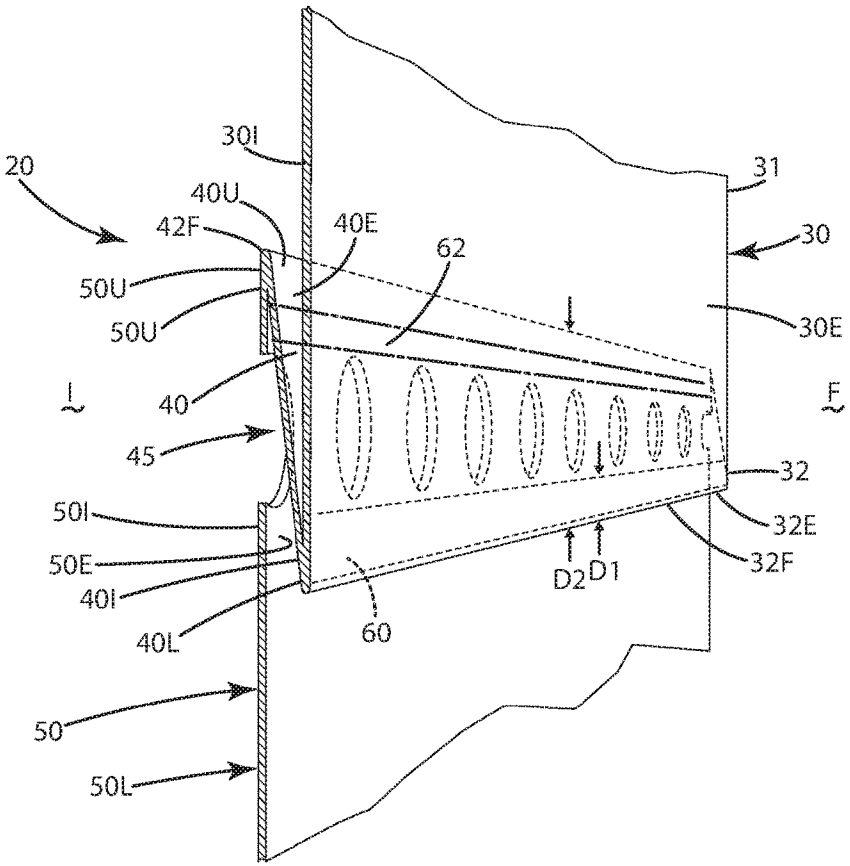
FIG. 4 is a perspective view of the vent system.
Figure 3:
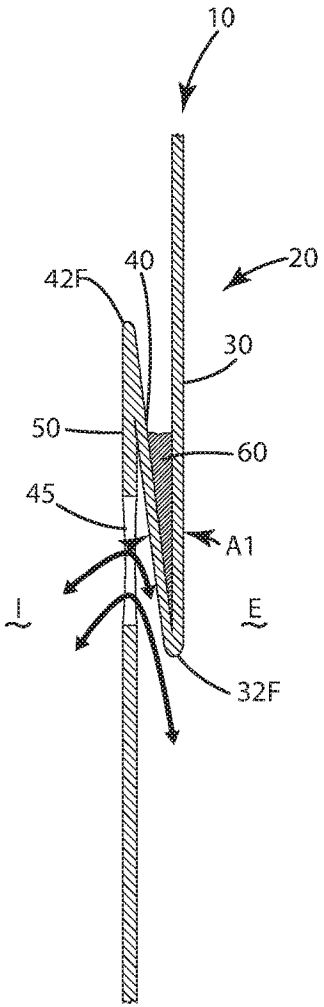
FIG. 3 is a section view of the vent system illustrating the various panels thereof.

As shown in FIGS. 2-4, the ventilation system 20 can include multiple panels, which can all be a portion of or integrally formed with the back panel 14. As an example, the ventilation system 20, shown in FIG. 4 can include an overlap panel 30, an intermediate panel 40 and an inner panel 50. All of these panels can be integrally formed with, and contiguous with, one another. These panels can form an integral, unitary piece of material, panel or sheet. All of these panels can be seamlessly joined with one another. These panels can form different integral portions of the back panel 14. In other applications, where the ventilation system is included in other components of the garment, the panels can form different integral portions of other panels, such as a front panel, sleeves, shoulder panels and the like.

The overlap panel 30 can include an upper portion 31 and a lower portion 32. The upper portion 31 can be joined with the shoulder portion or panel 12 and/or the collar 12 C. The lower portion 32 can form a lower end 32E of the overlap panel 30. This lower portion 32 can be folded at the end 32E to form a first fold line or outer fold 32F. The overlap panel 30 extends downward generally toward the outer fold 32F. At this outer fold, the lower portion of the overlap panel 30 transitions to the intermediate panel 40. The overlap panel 30 can include an overlap panel exterior surface 30E and an overlap panel interior surface 30I. The exterior surface 30E faces outward and is open to the environment E. The inner interior surface 30I faces inward toward an interior I, and generally toward the wearer when the jacket is worn.

The intermediate panel 40 includes an intermediate panel lower portion 40L. This lower portion 40L is disposed immediately adjacent the outer fold 32F. This intermediate panel lower portion 40L is continuous with an seamlessly joined with the first lower portion 32 of the overlap panel 30. These two components are part of a contiguous integral piece of material. The outer fold 32F can be in the form of a crease, a bend or a fold that arbitrarily separates the overlap panel 30 and the intermediate panel 40. The intermediate panel 40 can extend an upward direction, generally angled inwardly toward the interior I of the garment 10. The intermediate panel 40 can include an intermediate panel interior surface 40I and an intermediate panel exterior surface 40E. The intermediate panel exterior surface 40E can be adjacent and/or facing toward the overlap panel interior surface 30I as shown in FIGS. 3 and 4. The intermediate panel 40 can be disposed at an angle A1 relative to the overlap panel 30. This angle A1 can be an acute angle, optionally between 0° and 30°, further optionally between 0° and 15°, yet further optionally between 0° and 5°, inclusive for all given values.

The intermediate chant panel 40 can transition upward to an upper portion 40U disposed above the first lower portion 32 of the overlap panel 30 as well as the intermediate panel lower portion 40L. The intermediate panel 40 can be completely concealed behind the overlap panel 30, with no portion of the intermediate panel 40 extending below the outer fold 32F. The intermediate panel can extend in an opposite direction, that is up, rather than down, from the overlap panel 30. At the outer fold and where these panels are joined, the elements can be void of any stitching that join the intermediate panel to the overlap panel.

Figure 5:
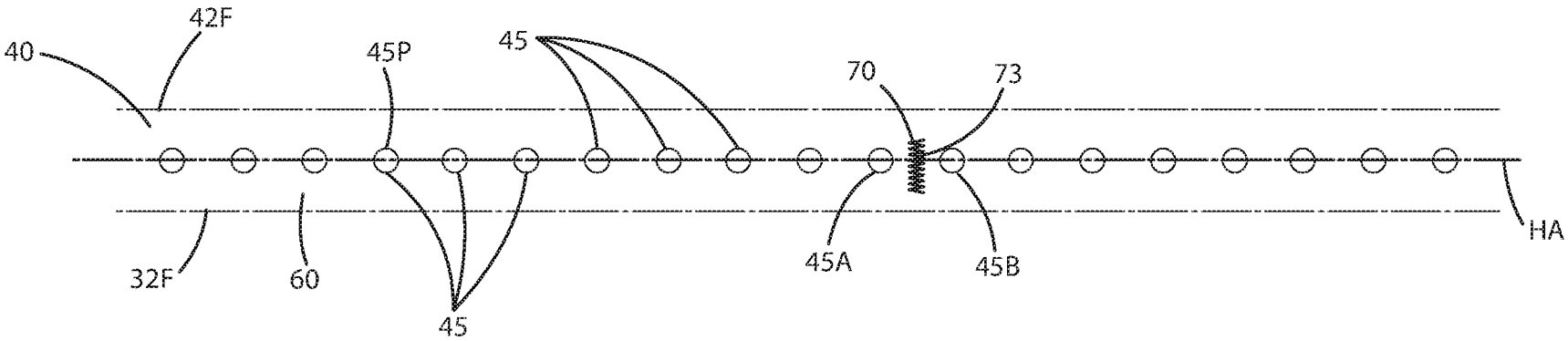
FIG. 5 is a partial back view of the vent system.

Optionally, the intermediate panel 40 can be joined with the overlap panel 30 with a component other than the outer fold 32F. For example, as shown in FIGS. 3-5, the ventilation system 20 can include a bonding element 60. This bonding element can be in the form of bonding tape, a sonic or other weld, adhesive, cement, double-sided tape, a stitch line above the fold 32F or some other material that removably secures the intermediate panel to the overlap panel in a particular region. As illustrated, the bonding element 60 is in the form of a strip of bonding tape. The bonding tape optionally can be 2 mm, 4 mm, 6 mm, 8 mm in width. The bonding tape can extend upward from the outer fold 32F a distance D1. This distance D1 can be optionally less than the distance D2 which can correspond to a width of the intermediate panel, spanning between the outer fold 32F and the inner fold 42F. This distance D1 can be optionally less than half the distance D2, which is the width of the intermediate panel, further optionally less than one third the distance D2, yet further optionally less than one quarter the distance D2. This bonding element can be disposed between the intermediate panel interior surface 30I and the intermediate panel exterior surface 40E, optionally extending to, or overlapping and joined with or adjacent the outer fold 32F. This bonding element can add stability and mass to the adjacent panels, and some cases assist the intermediate panel 40 to remain extending in a generally upward direction. In other cases, it can add enough weight to the panels adjacent the outer fold 32F so that that outer fold continues to hang downward and cover the plurality of holes 45 as described below.

The intermediate panel 40 can extend to the inner fold 42F, where that panel transitions to the inner panel 50. This fold can be 42F can be a fold, bend and/or crease, and can be similar to the outer fold 32F except disposed in an opposite orientation. The inner panel 50 can be seamlessly joined with the upper portion 40U at this inner fold 42F. In particular, an inner panel upper portion 50U can be joined with the upper portion 40U of the intermediate panel 40U at the fold 42F. These two panels can be contiguous and part of an integral unitary piece or sheet. At the inner fold, and where these panels are joined, the elements can be void of any stitching that join the intermediate panel to the inner panel.

At the inner fold 42F, the intermediate panel upper portion 40U can transition to an inner panel upper portion 50U. From there, the inner panel 50 can extend downward, optionally parallel to the overlap panel 30. The inner panel 50 can include an inner panel interior surface 50I that faces toward the interior I, and an opposing inner panel exterior surface 50E the faces outward toward the exterior E. The inner panel exterior surface 50E also can be adjacent and face toward the intermediate panel interior surface 40I. However, due to the overlap panel and the intermediate panel laying over the inner panel, the exterior surface 50E is at least partially if not completely covered by the intermediate panel and the overlap panel, so it optionally is not exposed to the exterior E. The inner panel 50 can extend downward, beyond the first lower portion 32 of the overlap panel 30, so that a second lower portion 50L of the inner panel 50 is visible below the first lower portion 32 of the overlap panel 30. Optionally, the inner panel lower portion 50L can be at least twice as long as the overlap panel 30 disposed above the outer fold line 32F.

Optionally, in some embodiments, a second strip 62 of bonding tape or some other bonding element can be joined between the intermediate panel and the inner panel, for example as shown in FIG. 4. There, the second strip 62 of bonding tape can be disposed between the intermediate panel interior surface 40I and the inner panel exterior surface 50I adjacent the second fold 42F and optionally up to that second fold. This second strip 62 of bonding tape can be disposed above the uppermost portions of the plurality of holes 45 so that those holes remain open generally open. Of course, in some cases, the strip of bonding tape 62 can overlap those holes.

As mentioned above, at least one of the inner panel 50 and the intermediate panel 40 can define one or more holes 45. As shown in FIGS. 3-5, those holes 45 can be disposed and defined by the inner panel 40. Those holes can extend through the inner panel, from the inner panel interior surface to the inner panel exterior surface. Each of these vent holes can be bounded by a perimeter 45P. The perimeter can be formed by cutting the inner panel. For example, the perimeter can be cut with a laser cutter, a die cutting machine, a punch, or some other cutting device. As shown, the perimeter 45P can be formed via a laser cutter and form a laser cut perimeter. In such a case, the laser cut perimeter can include if multiple ends of strands that are cleanly cut and disposed with their ends at or near the perimeter. Optionally, those ends can be meltingly intermingled with one another, where the panel is constructed from multiple or fusible strands, a polymeric sheet or other material, for example a textile or fabric.

As further illustrated in FIG. 5, the holes 45 can be aligned in parallel along a hole axis HA. This hole axis can be parallel to the outer fold 32F and the inner fold 42F. This hole axis can correspond to the centers of the holes, or some other portion of each of the holes 45. The holes can be in the form of circular apertures, but of course can take on a variety of other geometric shapes and configurations. For example, the holes can be polygonal, elliptical, rounded, angular or other shapes. The holes optionally do not extend beyond the outer fold 32F and/or the inner fold 42F. Further, although shown as a single line of holes along a hole axis HA, there can be multiple lines or levels of holes defined by the inner panel in an array or other arrangement. In some cases, this array can be configured so that the plurality of holes mimic a mesh or similar open and vented material in the inner panel. Optionally, however, these holes do not extend below the lower portion 32 of the overlap panel 30. These holes also optionally do not extend below the outer fold 32F. In this manner, the holes can remain concealed by the overlap panel 30 when the overlap panel 30 is in its regular overlapping mode, as shown in FIG. 4. Of course, if the overlap panel 30 is lifted in direction L as shown in FIG. 2, the holes 45 defined by the inner panel 50 can be exposed as illustrated there. Further optionally, the intermediate panel and the overlap panel can be void of holes in an area where the intermediate panel and the overlap panel lay over the inner panel and in particular the vent holes. Of course, in certain applications, the intermediate panel can define its own set of holes along a hole axis or in some other configuration or array.

Although the vent holes can be configured in a variety of orientations relative to one another and the components of the panels, as illustrated, adjacent ones of the holes 45 can be placed optionally at least 2.5 mm away from one another, further optionally between 2 mm and 5 mm away from one another, yet further optionally at least 5 mm away from one another, even further optionally between 1 mm and 10 mm, inclusive, away from one another, and yet further optionally 8 mm away from one another. The holes 45 can be placed at preselected distances away from the inner fold 42F and the outer fold 32F. For example, each of the holes 45 can be placed optionally at least 1 mm away from the inner fold and from the outer fold, further optionally at least 4 mm away from the inner fold and from the outer fold, yet further optionally at least 6 mm away from the inner fold and from the outer fold, yet further optionally between 4 mm and 10 mm, inclusive, away from the inner fold and from the outer fold. Where the holes are in the form of circular apertures, they can have one or more diameters. The diameter can be optionally between 1 mm and 10 mm, inclusive, further optionally between 2 mm and 5 mm, inclusive, yet further optionally 4 mm in diameter.

Optionally, the ventilation system 20 can include one or more holddown elements 70 these holddown elements can be in the form of stitching, a sonic weld, and/or some other type of weld or melting of the panels relative to one another. As shown, the holddown element 70 can be in the form of a vertical stitching. This vertical stitching can be a zigzag stitch. The first stitching can be stitched in such a manner so as to stitch the overlap panel 30 to the intermediate panel 40 to the inner panel 50 along the vertical stitch line. The vertical stitch line 73, as shown in FIG. 5, can be disposed between adjacent holes 45A and 45B. Optionally the stitching 20 can cross the hole axis HA, and can be disposed between the inner fold 42F and the outer fold 32F. Optionally, this vertical stitch line 73 is substantially vertical and parallel to the longitudinal axis LA of the garment 10, and transverse or perpendicular to the hole axis HA. The vertical stitch line 73 can be disposed such that it does not cross or extend over any one of the plurality of holes 45. The stitch line also can be configured so that it does not extend beyond the lower portion 32 of the overlap panel 30.

With reference to FIG. 2, the bonding element 70 can be configured to secure the overlap panel, the intermediate panel, and the interior panel directly to one another, however, to the left 70L and to the right 70R of the bonding element or stitch line 73, the overlap panel, intermediate panel and interior panel can be generally free to move, unattached by the stitching. Thus, the intermediate panel and overlap panel can be lifted somewhat in direction L to expose the inner panel and some of the vent holes. Near to the stitch line 73, however, the overlap panel and intermediate panel may not be movable to a significant a degree as those panels are farther away from the vertical stitch line 73 or bonding element 70. As will be appreciated, multiple bonding elements or stitch lines can be added to the ventilation system 20 across the width W of the garment and depending on the particular application and amount of venting.

A method of making a garment such as the jacket 10 illustrated in FIGS. 1-5 will now be described briefly. To make such a garment, pieces of the garment 10 can be cut from one or more sheets of material. For example, the pieces that make up the sleeves 11A and 11B, the shoulder portion 12 and the collar 12C, as well as the front panel 13 and the back panel 14 can be cut from a sheet of material. These various pieces can be formed into their respective components and structures for inclusion in the garment 10. These components also can be sewn, glued, adhered, taped or otherwise joined with one another along their respective edges.

The back panel 14, however, can be constructed to include the ventilation system 20 as described above. As an example, the back panel can be a single unitary sheet of textile material. This sheet of unitary sheet of material can be folded a first time to produce on one side of an outer fold 32F and overlap panel 30 including a first lower portion 32, an overlap panel interior surface and overlap panel exterior surface. On the second side of the outer fold 32F, an intermediate panel 40 can be formed and seamlessly joined with the first lower portion 32 of the overlap panel 30. The intermediate panel 40 can include an intermediate panel interior surface 40I and intermediate panel exterior surface 40E. The exterior surface 40E can face toward the overlap panel interior surface 30I. That same unitary sheet of material can be folded a second time at or otherwise to form an inner fold 42F. This in turn produces an inner panel 50 seamlessly joined with the upper portion 40U of the intermediate panel 40. The inner panel 50 can include an inner panel interior surface 50I and inner panel exterior surface 50E. The exterior surface 50E can face toward the intermediate panel interior surface 40I. The inner panel, after the folding, can also extend downward, beyond the outer fold 32F, and generally beyond the first lower portion 32 of the overlap panel 30. In this manner, the lower portion 50L of the inner panel 50 is exposed to the environment E beyond or below that outer fold 32F.

One or more vent holes 45 can be defined in at least one of the intermediate panel 40 and the inner panel 50. These vent holes 45, after the respective folding, can be concealed by the overlap panel 30, with the outer fold 32F being disposed below the vent holes. Optionally, a bonding element such as bonding tape 60 can be disposed and bonded between the overlap panel 32, and the intermediate panel 40. The vent holes 45 can be constructed as mentioned above using a variety of cutting machines, optionally a laser cutting machine. Each of the vent holes 45 can be cut in the form of the holes described above, having similar distances between one another, sizes and distances from other components. Optionally, the bonding elements, such as vertical stitch line 70 can be added to the ventilation system 20. After the back panel is constructed, it can be joined with the other panels and components of the garment via sewing and stitching at seams.

Figure 6:
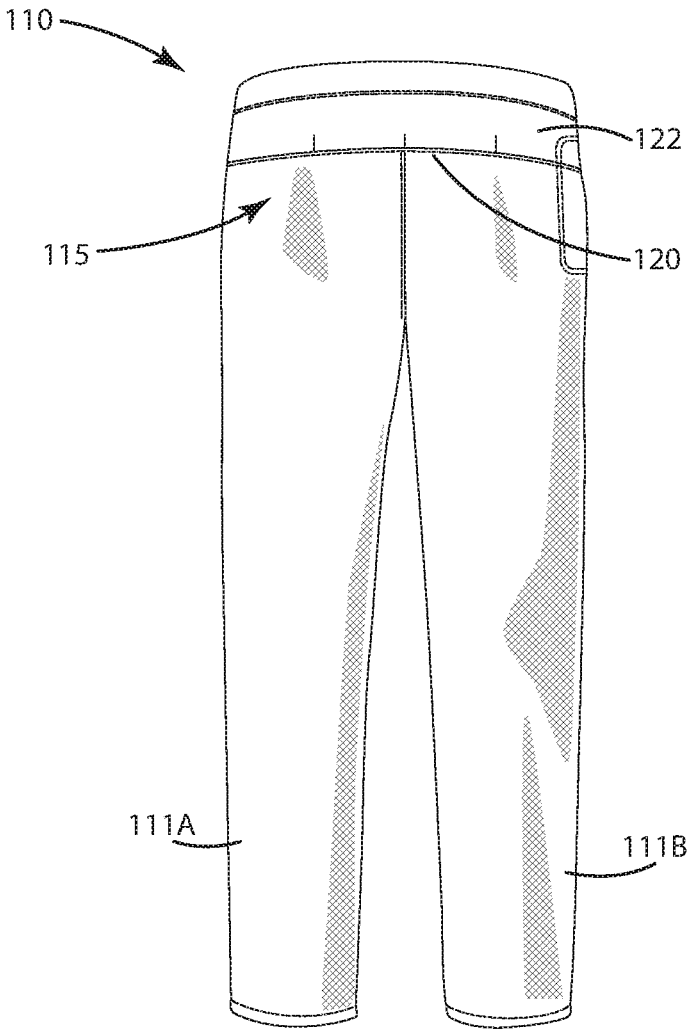
FIG. 6 is a view of another garment including a vent system of a first alternative embodiment.
Figure 7:
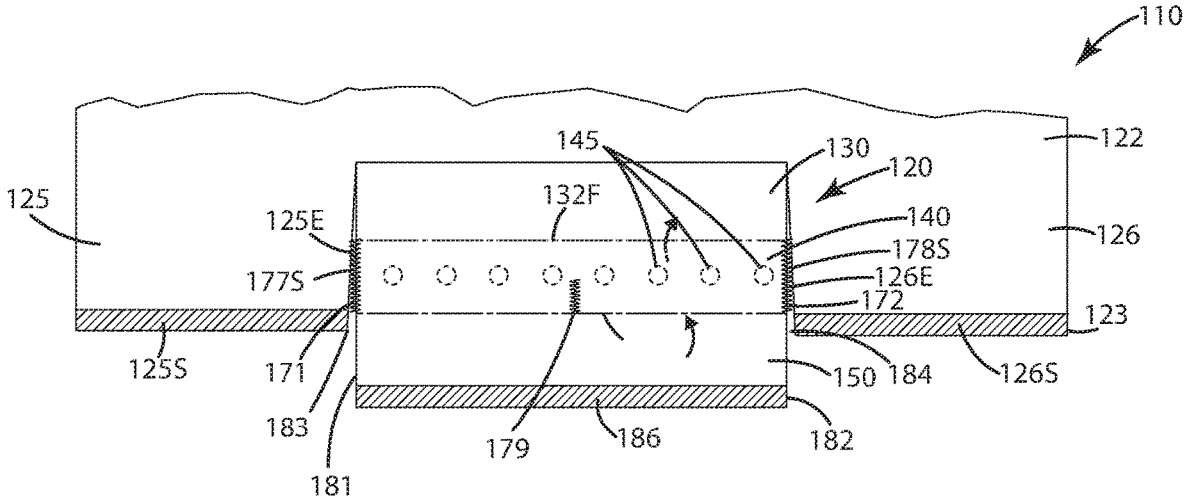
FIG. 7 is a view of the vent system thereof in an expanded, preassembly state.
Figure 8:
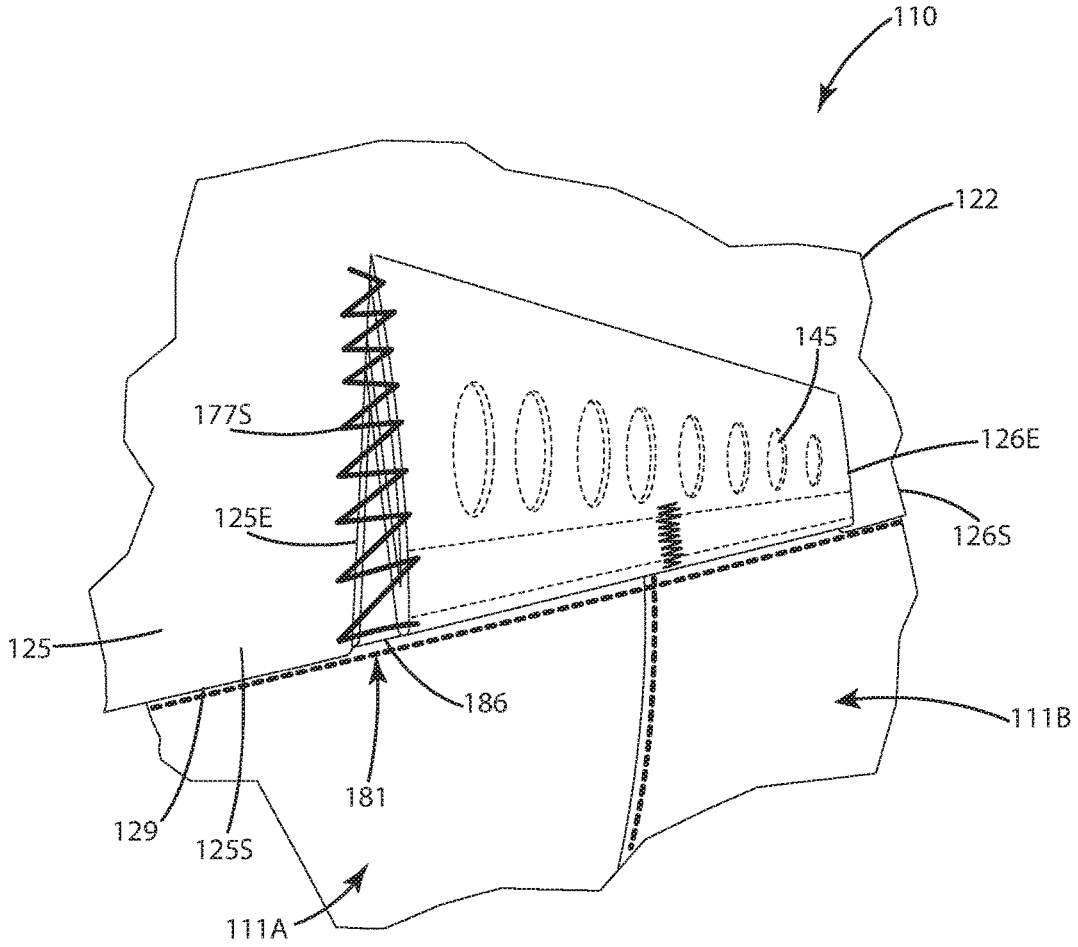
FIG. 8 is a perspective view of the vent system thereof.

A first alternative embodiment of a garment 110 including another ventilation system 120 is illustrated in FIGS. 6-8. This embodiment can be similar in structure, function and operation to the embodiment described above with several exceptions. For example, the garment 110 can be in the form of pants. The pants can include first and second legs 111A and 111B, and a posterior portion 115. The posterior portion 115 can include the ventilation system 120. The garment 120 can include an upper posterior panel 122. This upper posterior panel 122 can include the ventilation system 120. This ventilation system 120 can be generally centered as shown, and located above the leg panels 111A and 111B. The posterior panel can include a seam allowance 123 that generally extends along the bottom of the posterior panel 122.

The posterior panel 122 can be constructed from unitary, contiguous sheet of material such as those described above. The posterior panel, however, can include an overlap panel 130, an intermediate panel 140 and an inner panel 150. Disposed laterally of each of these panels, can be a first side panel 125 and a second side panel 126. The side panels generally flank the collection of the overlap panel 130, the intermediate panel 140 in the inner panel 150. These panels 130, 140, 150 can cooperatively define a first edge 181 and a second edge 182. These edges can be positioned adjacent the inner edges 125E and 126E of the respective first and second panels.

As shown in FIG. 7, the overlap panel 130, the intermediate panel 140 and the inner panel 150 can form a continuous panel bordered by respective slits or gaps 183 and 184 on opposite sides thereof. The intermediate panel 140 can be folded at the outer fold 132F upward and placed adjacent the interior surface of the overlap panel 130. The inner panel 150 likewise can be folded at the inner fold 142F. These panels accordingly can be folded generally upward so that the intermediate panel 140 is concealed behind the overlap panel 130. Accordingly, the holes 145 also can be concealed behind the overlap panel 130 when the panels are assembled and stitched in place.

The seam allowance 186 on the inner panel 150 also aligns with the respective seam allowances 125S and 126S on the respective first side panel 125 and second side panel 126. These allowances cooperatively make up the seam allowance 123 of the posterior panel 122.

As shown in FIG. 8, these components can be stitched with stitching along a horizontal or other stitch line 129 to the respective legs 111A and 111B of the garment 110. The respective edges 125E and 181 can be stitched together with a vertical first vertical stitch 177S. The second edge 182 can be stitched to the edge 126E of the other panel with the second stitch line 178S. Another optional vertical stitch line 179 can be stitched through the overlap panel, the intermediate panel and the inner panel similar to the vertical stitch lines described in the embodiment above.

Figure 9:
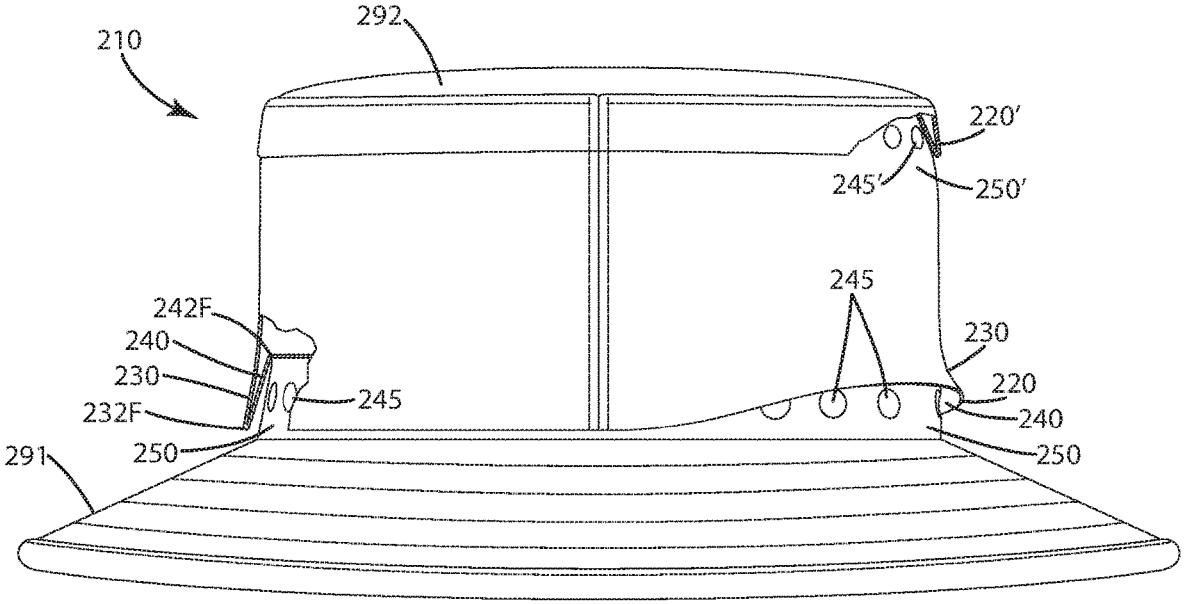
FIG. 9 is a view of another garment including a vent system of a second alternative embodiment.

A second alternative embodiment of a garment 210 including another ventilation system 220 is illustrated in FIG. 9. This embodiment can be similar in structure, function and operation to the embodiment described above with several exceptions. For example, the garment can be in the form of a hat 210. The hat 210 can include a brim 291 and a top 292. The hat 210 can include one or more ventilation systems 220 and 220'. The first ventilation system 220 can be disposed adjacent the brim, while the second ventilation system to 20' can be disposed closer to the top 292, above the lower ventilation systems. These ventilation systems can include a respective overlap panel 230, intermediate panel 240 and inner panel 250. The inner panel 250 can define a plurality of holes 245 for venting like the embodiments above. The overlap panel 230 can cover the ventilation holes 245. The overlap panel 230 also can be joined in unitary with the intermediate panel 240 transitioning to one another via an outer fold 232F. The inner panel 250 can transition to the intermediate panel 240 at the inner fold 242F. Optionally, in this embodiment, the overlap panel 230 for the lower ventilation system 220 also can serve as an inner panel 250' in the upper ventilation system to 20'. The other components of the upper ventilation system to 20' can be similar to those described in the embodiments above.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A garment comprising:

an overlap panel extending in a downward direction, the overlap panel including a first lower portion, an overlap panel interior surface and an overlap panel exterior surface;

an intermediate panel joined with the first lower portion at an outer fold with the intermediate panel extending in an upward direction, the intermediate panel including an intermediate panel interior surface and an intermediate panel exterior surface, the intermediate panel exterior surface being adjacent and facing toward the overlap panel interior surface, the intermediate panel including an upper portion disposed above the first lower portion;

an inner panel joined with the upper portion at an inner fold with the inner panel extending in the downward direction, the inner panel including an inner panel interior surface and an inner panel exterior surface, the inner panel exterior surface being adjacent and facing toward the intermediate panel interior surface, the inner panel extending downward beyond the first lower portion of the overlap panel so that a second lower portion of the inner panel is visible below the first lower portion of the overlap panel and, a first strip of bonding tape disposed between the intermediate panel exterior surface and the overlap panel interior surface adjacent the outer fold, wherein the overlap panel, the intermediate panel and the inner panel form a unitary, continuous textile, wherein the inner panel defines a plurality of vent holes, wherein the plurality of vent holes extend through the inner panel from the inner panel interior surface to the inner panel exterior surface, wherein the plurality of vent holes are concealed by the overlap panel, whereby the plurality of vent holes are configured to promote venting of air from an interior of the garment to an exterior of the garment and vice versa.

2. The garment of claim 1, wherein each of the plurality of vent holes is bounded by a perimeter, the perimeter being a laser cut perimeter including a plurality of ends of strands disposed at the perimeter.

3. The garment of claim 1, wherein the overlap panel is stitched with a first stitching to the intermediate panel along a first vertical stitch line, wherein the intermediate panel is stitched with the first stitching to the inner panel along the first vertical stitch line, wherein the overlap panel, the intermediate panel and the inner panel are free to move, unattached by the first stitching, in a region to the left and a region to the right of the first vertical stitch line.

4. The garment of claim 1 comprising:

a second strip of bonding tape disposed between the intermediate panel interior surface and the inner panel exterior surface adjacent the inner fold but above the plurality of vent holes.

5. The garment of claim 1, wherein the intermediate panel and the overlap panel are void of vent holes in an area where the intermediate panel and the overlap panel lay over the inner panel.

6. The garment of claim 1, wherein adjacent ones of the plurality of vent holes are each placed at least 2.5 mm away from one another, wherein the plurality of vent holes are disposed along a hole axis that extends parallel to the inner fold and the outer fold, wherein the plurality of vent holes are each placed at least 1 mm away from the inner fold and the outer fold.

7. The garment of claim 6, wherein each of the plurality of vent holes is round and has a diameter of between 1 mm and 10 mm, inclusive, wherein the intermediate panel exterior surface is adhered to the overlap panel interior surface from adjacent the outer fold to adjacent, but below, the plurality of vent holes.

8. The garment of claim 7, comprising:

a vertical stitch line of stitching stitched between adjacent ones of the plurality of vent holes to stitch the overlap panel to the intermediate panel to the inner panel.

9. A garment comprising:

an overlap panel including a first lower portion, an overlap panel interior surface and an overlap panel exterior surface;

an intermediate panel joined with the first lower portion at an outer fold, the intermediate panel including an intermediate panel interior surface and an intermediate panel exterior surface, the intermediate panel exterior surface facing toward the overlap panel interior surface, the intermediate panel including an upper portion disposed above the first lower portion;

an inner panel joined with the upper portion at an inner fold, the inner panel including an inner panel interior surface and an inner panel exterior surface, the inner panel exterior surface facing toward the intermediate panel interior surface, the inner panel extending downward beyond the first lower portion of the overlap panel;

a strip of bonding tape disposed between the intermediate panel interior surface and the inner panel exterior surface adjacent the inner fold, wherein the overlap panel, the intermediate panel and the inner panel form a unitary, continuous body, wherein at least one of the intermediate panel and the inner panel define a plurality of vent holes, wherein the plurality of vent holes are concealed by the overlap panel, whereby the plurality of vent holes are configured to promote venting of air from an interior of the garment to an exterior of the garment and vice versa.

10. The garment of claim 9, comprising:

a first side panel disposed in a first direction laterally of the overlap panel, the intermediate panel and the inner panel, a second side panel disposed in a second direction laterally of the overlap panel, the intermediate panel and the inner panel, wherein the overlap panel, the intermediate panel and the inner panel cooperatively define a first edge and a second opposing edge that are each transverse to the outer and inner folds, wherein the first edge is adjacent the first side panel, wherein the second opposing edge is adjacent the second side panel, wherein at least one of the overlap panel, the intermediate panel and the inner panel are joined at a seam with at least one of the first side panel and the second side panel.

11. The garment of claim 10, wherein the intermediate panel is stitched with a first vertical stitching to an inner edge of the first side panel, wherein the intermediate panel is stitched with a second vertical stitching to an inner edge of the second side panel, wherein a width of the intermediate panel separates the first and second vertical stitching.

12. The garment of claim 11, wherein the first lower portion of the overlap panel includes a first seam allowance, wherein the first side panel includes a second seam allowance, wherein the second side panel includes a third seam allowance, wherein the first seam allowance, the second seam allowance and the third seam allowance are linearly aligned with one another and configured to be stitched to a secondary piece of material.

13. The garment of claim 9 comprising:

wherein the intermediate panel defines the plurality of vent holes.

wherein the intermediate panel exterior surface is adhered to the overlap panel interior surface from adjacent the outer fold to adjacent, but below, the plurality of vent holes.

14. The garment of claim 13, wherein the inner panel defines the plurality of vent holes.

wherein the intermediate panel exterior surface is adhered to the overlap panel interior surface from adjacent the outer fold to adjacent, but below, the plurality of vent holes.

15. The garment of claim 14, comprising:

a vertical joining line between adjacent ones of the plurality of vent holes to join the overlap panel to the intermediate panel to the inner panel at the vertical joining line, wherein the overlap panel, intermediate panel and inner panel are free to the right and to the left of the vertical joining line.

16. The garment of claim 15, wherein the vertical joining line is a zig zag stitch.

* * * * *